US009150385B2

(12) United States Patent
Gewinner et al.

(10) Patent No.: US 9,150,385 B2
(45) Date of Patent: Oct. 6, 2015

(54) SYSTEM FOR PROVIDING DC POWER TO ELEVATOR CAR

(75) Inventors: Juergen Gewinner, Berlin (DE); Stefan Lothar Seelmann, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 764 days.

(21) Appl. No.: 13/503,921

(22) PCT Filed: Oct. 29, 2009

(86) PCT No.: PCT/US2009/062525
§ 371 (c)(1),
(2), (4) Date: Apr. 25, 2012

(87) PCT Pub. No.: WO2011/053294
PCT Pub. Date: May 5, 2011

(65) Prior Publication Data
US 2012/0217099 A1 Aug. 30, 2012

(51) Int. Cl.
*B66B 1/08* (2006.01)
*B66B 13/14* (2006.01)

(52) U.S. Cl.
CPC ..... *B66B 13/143* (2013.01)

(58) Field of Classification Search
CPC ..... B66B 1/30; B66B 1/302; B66B 13/02; B66B 13/143; B66B 11/0025
USPC ..... 187/247, 290, 293, 316, 317, 391–393
See application file for complete search history.

(56) References Cited

U.S. PATENT DOCUMENTS

| | | | | |
|---|---|---|---|---|
| 4,376,471 | A * | 3/1983 | Uchino et al. | 187/290 |
| 4,544,873 | A | 10/1985 | Salihi et al. | |
| 5,341,902 | A * | 8/1994 | Ruiz et al. | 187/251 |
| 5,601,156 | A * | 2/1997 | McCarthy et al. | 187/249 |
| 5,732,795 | A * | 3/1998 | McCarthy et al. | 187/250 |
| 6,315,081 | B1 * | 11/2001 | Yeo | 187/290 |
| 6,827,182 | B2 * | 12/2004 | Araki | 187/290 |
| 7,104,363 | B2 * | 9/2006 | Mori et al. | 187/290 |
| 7,228,942 | B2 | 6/2007 | Takehara et al. | |
| 7,681,694 | B2 * | 3/2010 | Aulanko et al. | 187/290 |
| 7,896,137 | B2 * | 3/2011 | Ishikawa | 187/290 |
| 8,172,042 | B2 * | 5/2012 | Wesson et al. | 187/382 |

(Continued)

FOREIGN PATENT DOCUMENTS

| | | |
|---|---|---|
| CN | 1066040 A | 11/1992 |
| CN | 1359845 A | 7/2002 |

(Continued)

OTHER PUBLICATIONS

English Translation of German Office Action, dated Jun. 25, 2013.

(Continued)

*Primary Examiner* — Anthony Salata
(74) *Attorney, Agent, or Firm* — Cantor Colburn LLP

(57) ABSTRACT

The present invention relates to an elevator door controller system for operating doors of an elevator car. The system includes a travelling cable for delivering DC power to the car. The car includes a power storage device for storing DC power from the travelling cable, a DC motor for operating the car doors, and an elevator door drive powered by the power storage device for driving the DC motor to operate the car doors.

19 Claims, 3 Drawing Sheets

(56) References Cited

U.S. PATENT DOCUMENTS

| | | | | |
|---|---|---|---|---|
| 2001/0008195 | A1 | 7/2001 | Tajima et al. | |
| 2002/0053490 | A1* | 5/2002 | Banno et al. | 187/290 |
| 2004/0256181 | A1* | 12/2004 | Durand et al. | 187/316 |
| 2005/0173197 | A1 | 8/2005 | Takehara et al. | |
| 2012/0247878 | A1* | 10/2012 | Banno | 187/413 |

FOREIGN PATENT DOCUMENTS

| | | | |
|---|---|---|---|
| CN | 201051674 | Y | 4/2008 |
| DE | 7725375 | U | 2/1978 |
| DE | 10144934 | A1 | 9/2001 |
| EP | 1522519 | A1 | 4/2005 |
| GB | 2255204A | A | 10/1992 |
| JP | 0958953 | A | 3/1997 |
| JP | H0958953 | A | 3/1997 |
| JP | 2001025275 | A | 1/2001 |
| JP | 2001072348 | A | 3/2001 |
| JP | 2001072648 | A | 3/2001 |
| JP | 2003054848 | A | 2/2003 |
| JP | 2004269204 | A | 9/2004 |
| JP | 2005104608 | A | 4/2005 |
| JP | 2010080128 | A | 4/2010 |
| KR | 1020040029175 | | 2/2005 |
| KR | 100537770 | B1 | 12/2005 |

OTHER PUBLICATIONS

Notice of Reasons for Refusal from KR patent application serial No. KR10-2012-7013597, dated May 16, 2013, 10 pages.
International Search Report, mailed Jul. 27, 2010.
Chinese Office Action for application CN 200980162290.7, mailed Sep. 9, 2014, 14 pages.
Notification of Reason(s) for Refusal, from Korean Patent Office of May 16, 2013.

* cited by examiner

SYSTEM FOR PROVIDING DC POWER TO ELEVATOR CAR

BACKGROUND OF THE INVENTION

The present invention generally relates to elevator systems, and more particularly to elevator door controller systems within elevator systems.

Typical elevator systems include an elevator car attached to a counterweight by roping. A hoist motor and a brake act together to move the elevator car and counterweight up and down an elevator shaft, transporting passengers or cargo from one floor to another. An elevator drive and controller provide power to and control operation of the elevator system.

Door controller systems of elevators are used to open and close elevator doors to allow passengers or cargo on and off the elevator car. Powering a door controller system typically includes a controller to supply the power, a travelling cable connecting the controller and the car to deliver power to the car, a car operating panel to operate car fixtures, and a door drive system to operate car doors.

The car operating panel serves to operate fixtures in the car, such as indicator lights. The panel is powered by a DC power supply from a DC power supply unit in the controller. Power is delivered to the car operating panel through DC power lines in the travelling cable.

The door drive system typically includes a transformer, a door motor drive and a DC motor. The door drive system is powered by an AC power line through the travelling cable. The AC power connects to the transformer, which converts the power to DC power to supply to the door motor drive, which powers the DC motor to operate elevator car doors.

Additionally, the controller contains a rescue supply unit to provide backup power to the system in case of a power outage. This enables elevator car doors to open and let passengers out even if the main power supply is not available.

BRIEF SUMMARY OF THE INVENTION

An embodiment of the present invention relates to an elevator door controller system for operating doors of an elevator car. The system includes a travelling cable for delivering DC power to the car, a power storage device for storing DC power from the travelling cable, a DC motor for operating the car doors, and an elevator door drive powered by the power storage device for driving the DC motor to operate the car doors.

A method of powering an elevator door controller system for operating doors of an elevator car includes supplying DC power through a travelling cable to a power storage device on the elevator car; storing the DC power from the travelling cable in the power storage device; and operating the doors with a DC motor driven by an elevator door drive powered by the power storage device.

DETAILED DESCRIPTION

The present invention provides an elevator door controller system powered by low voltage DC current. In an elevator door controller system there is generally a peak demand for power when doors on an elevator car are opening. Less power is used to close car doors, and a small amount of power is needed to hold car doors open or closed. So while peak power demands to open elevator car doors are high, over time the power demand of the elevator door controller system is moderate. To supply peak power demands, elevator door controller systems typically require a high voltage AC power line running through a travelling cable to the elevator car. This invention allows the elimination of the AC power line by supplying DC power at low voltage delivered through the travelling cable, storing that DC power over a period of time in a power storage device on the car, and then delivering the accumulated power at the high voltage levels required to open elevator car doors when prompted.

Figure 1:
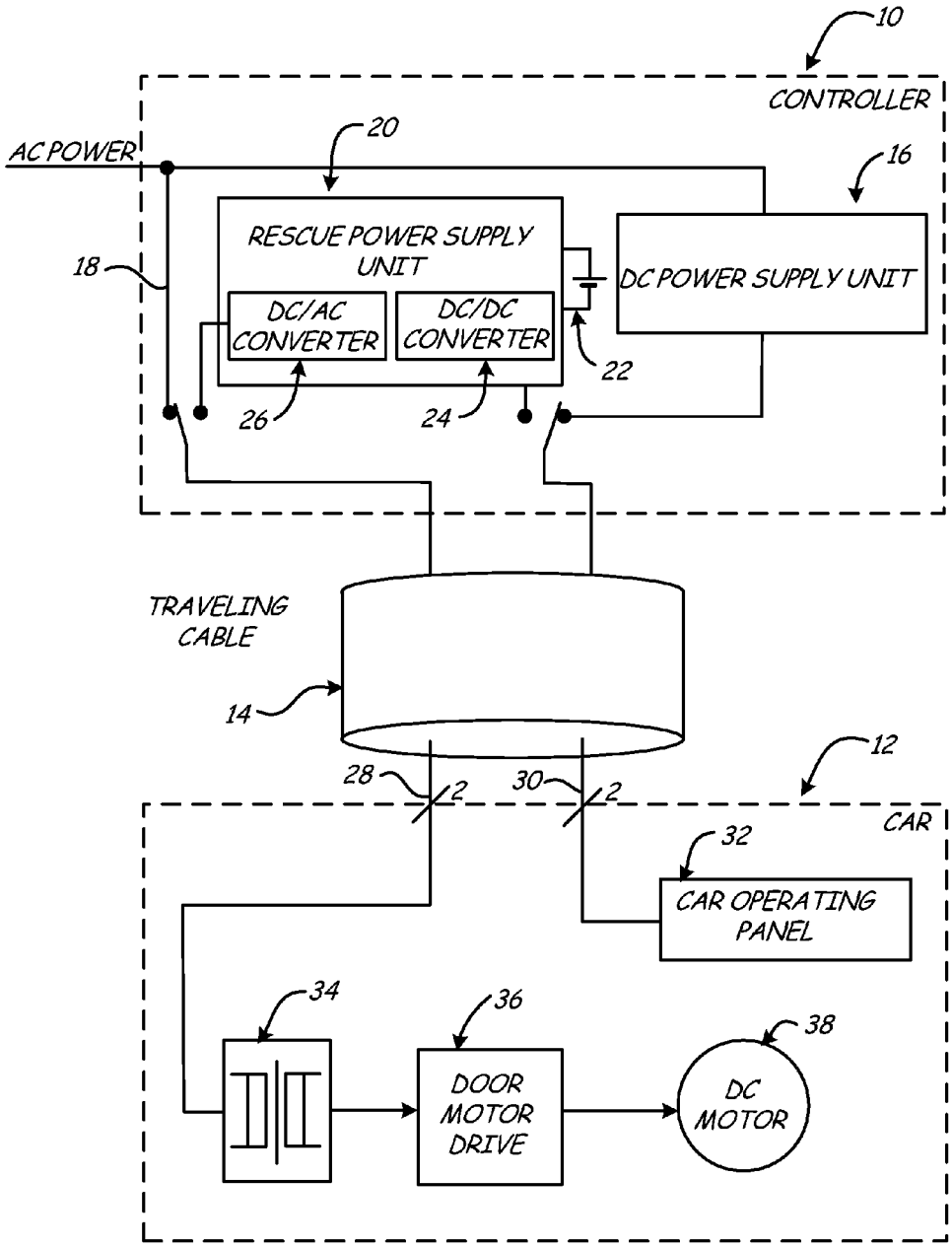
Fig. 1 PRIOR ART
FIG. 1 is a diagram of a prior art elevator door controller system.

FIG. 1 illustrates a diagram of a prior art elevator door controller system. The system includes controller 10, car 12, and travelling cable 14. Controller 10, which is typically located in a machine room area at an upper end of the elevator hoistway, includes DC power supply unit 16, rescue power supply unit 20, and AC power line 18. Rescue power supply unit 20 includes battery 22, DC/AC converter 26, and DC/DC converter 24. Travelling cable 14 includes two AC power wires 28 and two DC power wires 30. Car 12 includes car operating panel 32, transformer 34, door motor drive 36, and DC motor 38.

DC power supply unit 16 is connected to DC power wires 30 in travelling cable 14, which is then connected to car operating panel 32. AC power line is connected to AC power wires 28 in travelling cable 14, which is then connected to transformer 34. Transformer 34 is connected to door motor drive 36, which is then connected to DC motor 38. Battery 22 is connected to DC/AC converter 26 and DC/DC converter 24. DC/AC converter 28 is connected to AC power wires 28 in travelling cable 14 during a general power outage, in place of the normal AC power line 18 connection with travelling cable 14. DC/DC converter 24 is connected to DC power wires 30 in travelling cable 14 during a general power outage, replacing the DC power supply unit 16 connection to travelling cable 14.

Controller 10 supplies AC and DC power to car 12 through travelling cable 14. DC power supply unit 16 supplies DC power (generally around 30 volts, but may be more or less depending on different system needs) to two DC wires 30 in travelling cable 14 to deliver to car operating panel 32. Car operating panel 32 uses the DC power to operate car fixtures, such as indicators and indicator lights. AC power line 18 supplies AC power (generally around 230 volts, but may be more or less depending on different system needs) to two AC wires 28 in travelling cable 14 to deliver to transformer 34 on car 12. Transformer 34 converts the AC power to DC, and steps down the voltage of the AC power delivered by travelling cable 14. Door motor drive 36 powers DC motor 38 to operate elevator car doors.

Figure 2:
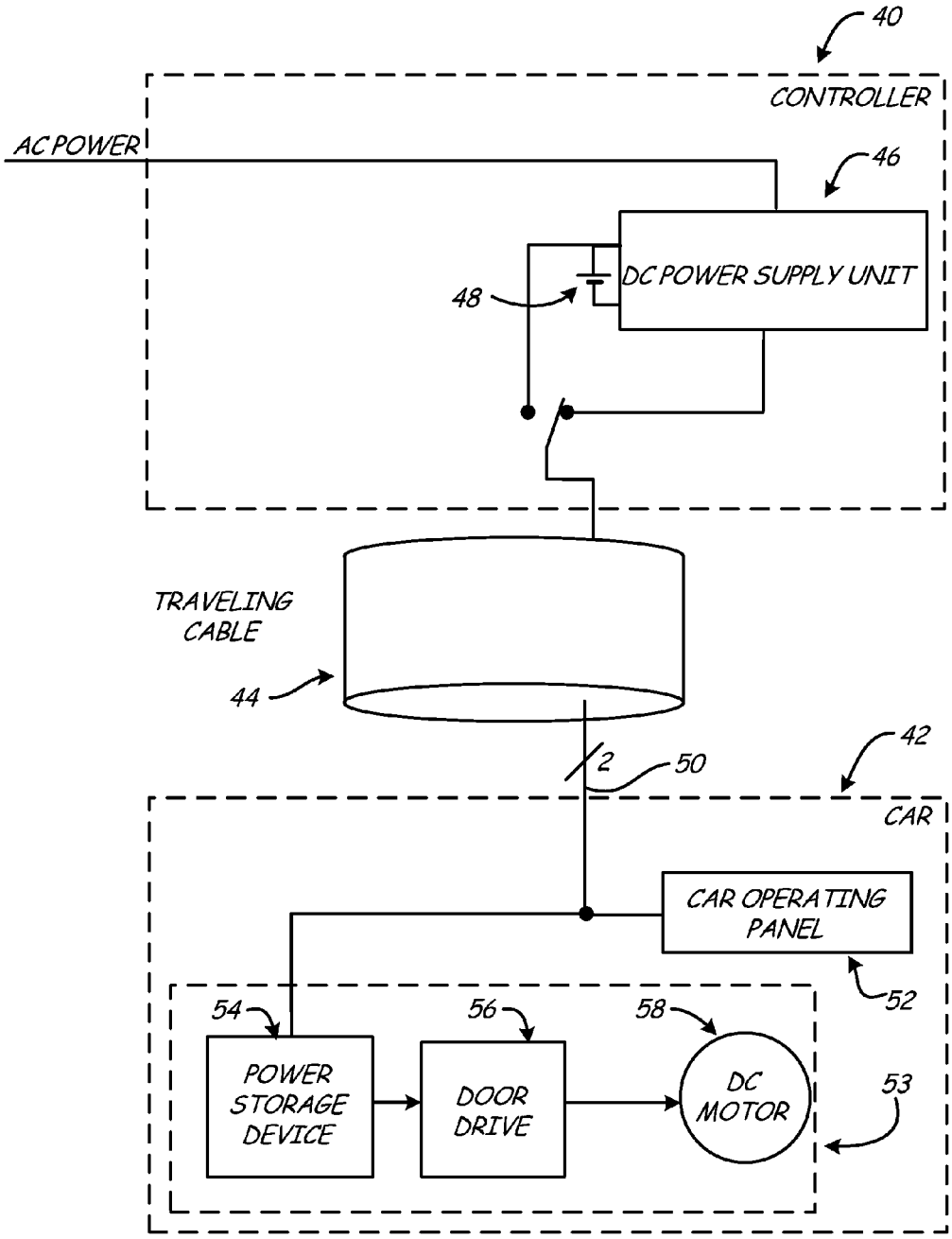
FIG. 2 is a diagram of an elevator door controller system according to the present invention.

FIG. 2 illustrates elevator door controller system of the current invention. The system includes controller 40, car 42, and travelling cable 44. Controller 40, which may be located at the machine room area, includes DC power supply unit 46 and battery 48. Travelling cable 44 includes two DC power wires 50. Car 42 includes car operating panel 52 and door drive system 53 (which includes power storage device 54, door drive 56, and DC motor 58).

DC power supply unit 46 is connected to DC wires 50 in travelling cable 44 which is then connected to car operating panel 52 and power storage device 54 on car 42. Power storage device 54 is connected to door drive 56, which controls operation of DC motor 58. In case of a general power outage, battery 48 is connected to DC wires 50 in travelling cable 44.

DC power supply unit 46 supplies power to car operating panel 52 and door drive system 53 in car 42. Battery 48 serves to supply DC power to system in case of a general power outage. Car operating panel 52, powered by DC power delivered by travelling cable 44, operates fixtures in car 42. Door drive system 53 is also powered by DC power supplied by controller 40 and delivered by DC wires 50 in travelling cable 44. Power storage device 54 stores DC power supplied by controller 40 delivered through travelling cable 44. Elevator door drive 56 uses stored power to drive DC motor 58 which operates elevator car doors.

By incorporating power storage device 54 into the door drive system, door drive system 53 and car operating panel 52 can be powered by low voltage DC power delivered through DC wires 50 in travelling cable 44. Low voltage power delivered by the travelling cable 44 is stored in power storage device 54, so that over time enough power is collected and available to provide for the high power demands at peak demand periods, specifically when opening elevator car doors. Power storage device 54 eliminates the need for AC wires through travelling cable 44, which previously have been used to supply power for the peak power demand periods of opening elevator car doors (see FIG. 1 prior art). Additionally, because the system does not require AC power being delivered to the elevator car, the transformer and the DC/AC converter of the prior art can be eliminated. In another embodiment, power storage device 54 can be integrated into door drive 56.

Figure 3:
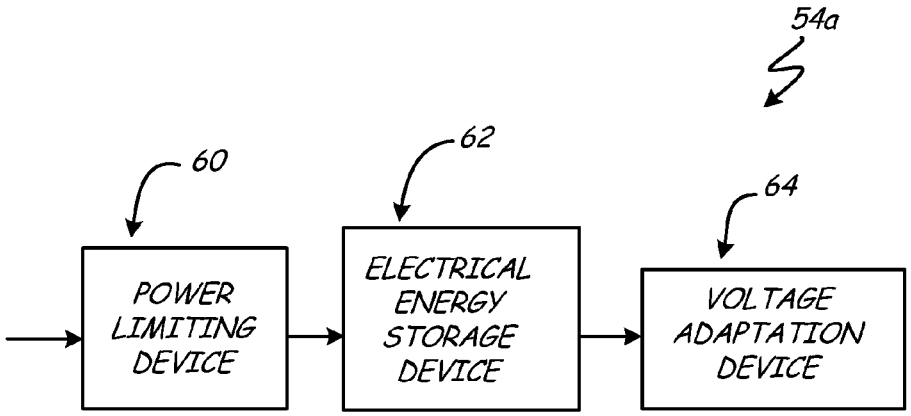
FIG. 3 is a block diagram of one embodiment of a power storage device according to the present invention.

FIG. 3 illustrates one embodiment of power storage device 54A. In this embodiment, power storage device 54A includes power limiting device 60, electrical energy storage device 62, and voltage adaptation device 64. Power limiting device 60 is connected to electrical energy storage device 62, which is then connected to voltage adaptation device 64.

Power limiting device 60 limits the amount of current going into electrical energy storage device 62 to ensure a proper and safe charge. Electrical energy storage device 62 operates to collect and store power from controller 40 delivered by travelling cable 44. Electrical energy storage device 62 can be a battery, a capacitor, or a bank of batteries or capacitors with enough storage capacity to meet peak demands of elevator door drive system. Voltage adaptation device 64 can be included, if necessary, to ensure power is delivered at desired voltages to meet demands of elevator door drive system.

Figure 4:
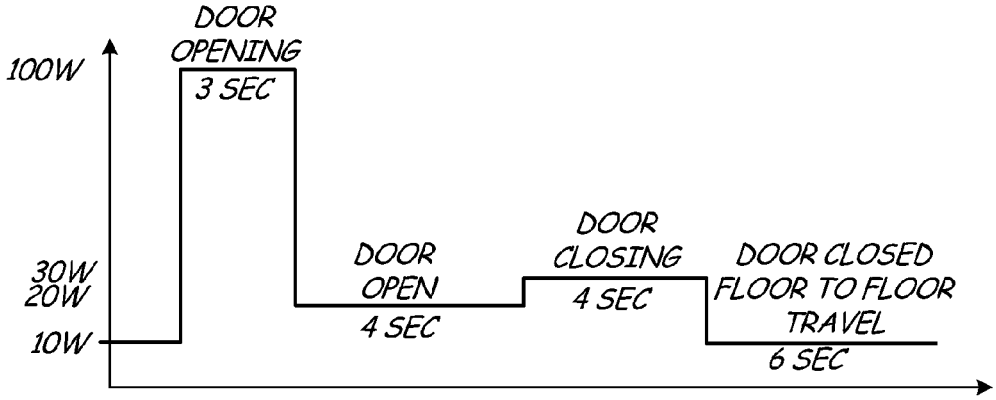
FIG. 4 is a graph of power demand of an elevator door drive over time, plotting power demands related to different states of operation of an elevator door system.

FIG. 4 is a graph illustrating approximate power demands of an elevator door drive system over time. Specifically, FIG. 4 shows time periods in which an elevator opens car doors, holds doors open to allow passengers in or out, closes car doors, and holds car doors closed to travel between one floor and another.

The period of opening the doors lasts about 3 seconds and requires about 100 watts per second. Holding the doors open to let passengers on or off lasts about 4 seconds and requires about 20 watts per second. Closing the doors takes about 4 seconds and requires about 30 watts per second. Floor to floor travel time takes about 6 seconds, and holding the doors closed during that time requires about 10 watts per second.

In total, over the 17 second period of opening doors, holding doors open, closing doors, and holding doors closed while travelling between floors, a total of 560 Ws is required. This averages out to be only about 33 watts per second. A power storage device allows the peak power demands to be met by continuously delivering low voltage DC power to the system. The power storage device collects power over time, and then delivers the power to meet peak power demands which occur when opening elevator doors. The timing of elevator cycles and power requirements shown on the graph is an approximation to illustrate the different power demands related to the status of the doors in typical elevator door drive systems. Different elevators may vary in specific power demands and cycle timing.

In summary, the current invention provides an elevator door controller system powered by delivering low voltage DC power from a controller, delivered through DC wires in a travelling cable, to an elevator car to power a car operating panel and a door drive system. To provide for peak power demands of the door drive system, the low voltage DC power delivered is collected over time in a power storage device, and then delivered in the higher power required for peak demand periods, such as opening elevator car doors. As mentioned above, by storing low voltage DC power and accumulating enough in the power storage device to provide the peak power required to open car doors, the need for the controller to provide AC power and for the travelling cable to deliver the AC power required for peak power demand periods is eliminated. This provides economic savings in eliminating the need for: high voltage AC wires in the travelling cable, a DC/AC converter connected to the battery for supplying backup power, and a transformer to transform the AC power delivered into DC power to power the door motor drive. This also provides cost-savings in terms of lower energy consumption by the overall system. It may even be possible to regenerate electrical energy during times when elevator car doors are being decelerated. In addition, by delivering low-voltage DC power over time, there is little voltage loss on the travelling cable, making the current invention especially useful for providing power to elevator systems in high-rise buildings where the travelling cable would have to be very long.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An elevator door controller system for operating car doors of an elevator car, the system comprising:

a DC power supply unit for supplying DC power;

a travelling cable for delivering DC power to the car, the travelling cable connected between the DC power supply unit and the car;

a power storage device located on the car for storing DC power from the travelling cable;

a DC motor for operating the car doors; and an elevator door drive powered by the power storage device for driving the DC motor to operate the car doors.

2. The system of claim 1, wherein the power storage device comprises one or more batteries.

3. The system of claim 1, wherein the power storage device comprises one or more capacitors.

4. The system of claim 1, wherein the DC power supply includes a converter to convert AC power to DC power.

5. The system of claim 1, wherein the power storage device comprises:

an electrical energy storage device to store power;

a power limiting device connected to the electrical energy storage device to limit the amount of current entering electrical energy storage device; and a voltage adaptation device connected to the electrical energy storage device to deliver power from the electrical energy storage device at required voltages to the elevator door drive.

6. The system of claim 1, wherein the power storage device is positioned in the elevator door drive.

7. The system of claim 1, and further comprising a car operating panel powered by the DC power from the travelling cable.

8. An elevator system, the system comprising:

an elevator car with doors;

a power supply located separate from the elevator car for supplying DC power;

a travelling cable connected between the power supply and the car for delivering DC power from the power supply to the car;

a power storage device for storing DC power from the travelling cable;

a DC motor for operating the car doors; and an elevator door drive powered by the power storage device for driving the DC motor to operate the car doors.

9. The system of claim 8 wherein the power storage device comprises one or more batteries.

10. The system of claim 8 wherein in the power storage device comprises one or more capacitors.

11. The system of claim 8 wherein the power supply includes a converter to convert AC power to DC power.

12. The system of claim 8 wherein the power storage device comprises:

an electrical energy storage device to store power;

a power limiting device connected to the electrical energy storage device to limit the amount of current entering electrical energy storage device; and a voltage adaptation device connected to the electrical energy storage device to deliver power from the electrical energy storage device at required voltages to the elevator door drive.

13. The system of claim 8, and further comprising a car operating panel powered by DC power from the travelling cable.

14. A method of powering an elevator door controller system for operating doors of an elevator car, the method comprising:

supplying DC power through a travelling cable connecting a DC power supply to a power storage device on the elevator car;

storing the DC power from the travelling cable in the power storage device; and operating elevator doors with a DC motor driven by an elevator door drive powered by the power storage device.

15. The method of claim 14 wherein the DC power supply supplies DC power to the travelling cable.

16. The method of claim 14 wherein the power storage device comprises one or more batteries.

17. The method of claim 14 wherein the power storage device comprises one or more capacitors.

18. The method of claim 14 wherein the DC power supplied through the travelling cable also powers an elevator car operating panel.

19. The system of claim 1, wherein power transmitted by the travelling cable consists of DC power.

* * * * *